US005346092A

United States Patent [19]

Gerhard, deceased

[11] Patent Number: 5,346,092

[45] Date of Patent: Sep. 13, 1994

[54] TANK HAVING AN INTERMEDIATE WALL

[75] Inventor: Helmut Gerhard, deceased, late of Weitefeld, Fed. Rep. of Germany, by Jan Gerhard-de Vries, Till Gerhard, heirs

[73] Assignee: Westerwaelder Eisenwerk Gerhard GmbH, Fed. Rep. of Germany

[21] Appl. No.: 993,075

[22] Filed: Dec. 18, 1992

[30] Foreign Application Priority Data

Dec. 30, 1991 [DE] Fed. Rep. of Germany ... 9116117[U]

[51] Int. Cl.[5] ..... B65D 25/00

[52] U.S. Cl. ..... 220/553; 220/565

[58] Field of Search ..... 220/565, 527, 553, 500

[56] References Cited

U.S. PATENT DOCUMENTS

| | | | |
|---|---|---|---|
| 2,269,617 | 1/1942 | Borstel . | |
| 2,453,463 | 11/1948 | Sherman | 220/553 |
| 3,383,002 | 5/1968 | Fleming et al. | 220/553 |
| 3,954,369 | 5/1976 | Kormendi | 220/553 |
| 3,982,653 | 9/1976 | Becker | 220/553 |
| 4,789,170 | 2/1988 | Reber . | |

FOREIGN PATENT DOCUMENTS

| | | | |
|---|---|---|---|
| 530000 | 7/1931 | Fed. Rep. of Germany | 220/553 |
| 3445221 | 12/1984 | Fed. Rep. of Germany . | |
| 2138252 | 1/1973 | France . | |
| 2534225 | 4/1984 | France . | |

*Primary Examiner*—Joseph Man-Fu Moy
*Attorney, Agent, or Firm*—Evenson, McKeown, Edwards & Lenahan

[57] ABSTRACT

A baffle or dividing wall 13, 14 disposed in a tank is connected to the inner wall of the tank jacket 10 via a ring 15, 21 of triangular profile. The outer diameter of the intermediate wall is significantly smaller than the inner diameter of the tank so that the wall may be readily inserted into the tank. One leg 16 of the proHie ring 15 forms an extension of the curvature of the intermediate wall 13, whereas the other leg 17 closes the gusset-type region between the convex side of the intermediate wall 13 and the tank jacket 10.

5 Claims, 1 Drawing Sheet

TANK HAVING AN INTERMEDIATE WALL

BACKGROUND OF THE INVENTION

A tank having a substantially cylindrical jacket and curved intermediate walls welded to the inner surface thereof is known from U.S. patent specification No. 4,789,170. Each intermediate wall is curved in a manner similar to the tank heads and serves as a baffle for preventing excessive surges of a liquid being transported, which surges may result in undesired reaction forces exerted on the transport vehicle, especially when the tank is partially filled.

In the manufacture of conventional tanks of this type, the intermediate walls, which may be baffles or dividing walls, are inserted in the axial direction of the tank and welded to the inner jacket wall before the tank is closed by the tank heads.

There is the problem that the dimensions of the intermediate wall must be somewhat smaller than the clear diameter of the tank, in order that the wall may be inserted into the tank in spite of any non-circular or uneven portions or the inner jacket surface caused in the manufacture.

Since the tank, in this condition, is still open at at least one end and since its cross-section will deform elliptically when the tank lies fiat, inserting a well fitting intermediate wall may even require the tank body to be set to an upright condition, which further complicates the assembly.

In spite of these measures, however, gaps between the outer edge of the intermediate wall and the inner jacket surface of the tank, which render a proper welding difficult or impossible, cannot be avoided.

For stability reasons, the intermediate wall is curved in a manner similar to tank head, particularly where it is intended to provide a complete subdivision of the interior tank space into a plurality of possible pressure-resistant chambers. In this case, a gusset-type area is created between the tank jacket and the peripheral portion of the intermediate wall on the convex side of the latter, where impurities may deposit and corrosion may occur.

It is therefore common to close this gusset area by an overall conical ring which has its larger edge welded to the jacket surface and its smaller edge welded to the convex side of the intermediate wall. Such a ring is advantageous also for pressure reasons when the tank chamber situated on the convex side of the intermediate wall is exposed to an over-pressure.

With intermediate walls having a basket-type curvature, just as with tank heads of this shape, the wall thickness is governed by the knuckle zone as the area exposed to maximum stress. Therefore, in known tanks, the large spherically curved central portion of the intermediate wall is usually excessively heavy.

Another tank is known from German Offenlegungsschrift 3,445,221 in which an intermediate wall of an overall flat design is connected to the inner jacket wall by means of rings of rectangular cross-section. One leg of each ring is fixed the tank and the other to the intermediate wall.

SUMMARY OF THE INVENTION

It is the object of the invention to provide a tank with an intermediate wall which may be inserted without problems into the tank and connected to the jacket wall by welding in such a way that the above gusset-type regions are avoided.

This object is met by a tank having a substantially cylindrical jacket and a curved intermediate wall fixed to the inner surface thereof, wherein the intermediate wall is fixed to a ring of an angular profile, the ring being welded to the tank jacket with an apex facing the interior of the tank.

The profile ring permits the intermediate wall to have outer dimensions that are significantly smaller than the inner diameter of the tank, so that it may be inserted into the latter without problems. The profile ring itself may be inserted as a band ring which is open at one location and may be cut to its exact peripheral length even after having been inserted into the tank. In the orientation in which the ring is welded to the inner tank wall, one of its legs will form an extension of the peripheral portion of the intermediate wall, and its other leg will fulfill the function of the above additional conical ring for sealing the gusset area.

The fact that the intermediate wall is composed of a profile ring and a curved disc, permits making the ring sufficiently strong to meet the increased stress occurring in this area without unduly increasing the thickness, and thus the weight, of the intermediate wall proper.

In a preferred embodiment, the ring has a hat-shaped profile and is welded to the tank jacket at the outer edges of its cylindrical flanges. Alternatively, the ring may have a T-profile with the lower edge of its center web and an outer edge of a transverse leg being welded to the tank jacket. In these embodiments, a ring of a particularly stable profile is obtained. The alternative version further permits the profile ring to be screwed to the intermediate wall.

According to a further embodiment, the peripheral portion of the intermediate wall extends substantially parallel to a leg of the ring. With this structure, the intermediate wall may be connected to the ring by two welds, one being formed at the apex of the profile ring and the other at the outer edge of the intermediate wall.

DETAILED DESCRIPTION OF PREFERRED EMBODIMENTS

Figure 1:
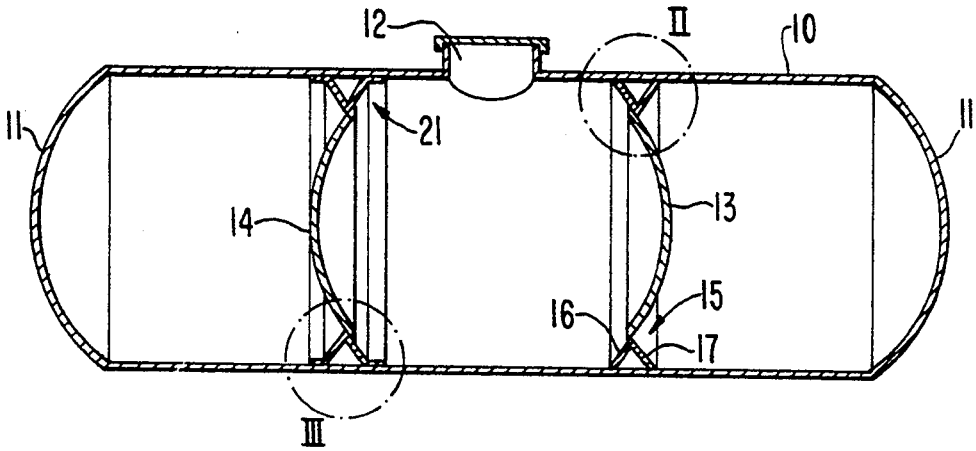
FIG. 1 shows a longitudinal section of a tank having two intermediate walls connected to the inner surface of the tank jacket by differently shaped rings.

The tank shown in FIG. 1 includes a generally cylindrical tank jacket 10 each end of which is closed by a curved head 11. A raised manhole 12 is shown at an axially intermediate portion.

Inserted into the interior of the tank are two intermediate walls 13, 14 which are curved similarly to the tank heads 11. The curvature may be purely spherical or basket-like. In the embodiment shown, the intermediate walls 13, 14 constitute baffles for preventing excessive surges of a liquid tank content during transport. They include interruptions (not shown) through which the three tank chambers communicate.

In an alternative embodiment, the intermediate walls 13, 14 may be formed as completely closed dividing walls for subdividing the total tank space into three separate chambers. In that case, each of the three tank chambers would have its own manhole and other installations for separate filling and emptying.

The intermediate wall 13 is fixed to the tank jacket by means of an angular ring 15 which has its apex facing the interior of the tank. As shown in detail in FIG. 2, the ring 15 has the ends of its two legs 16, 17 welded to the tank jacket 10. The outer diameter of the intermediate wall 13 is conspicuously smaller than the inner diameter of the tank jacket 10, but larger than the diameter of the inner edge of the ring 15. The peripheral portion 18 of the intermediate wall 13 thus overlaps the leg 16 of the ring 15.

The intermediate wall 13 is connected to the ring 15 by a first weld 19 provided between its outer edge and the leg 16 and a second weld 20 provided between its convex outer surface and the apex of the ring 15.

To avoid gaps between the leg 16 of the ring 15 and the intermediate wall 13 in the region of the welds 19, 20, the profile of the ring 15 is selected so that the outer surface of the leg 16 is substantially aligned with the outer surface of the peripheral portion 18 of the intermediate wall 13.

Additionally or alternatively, the peripheral portion 18 may be bent with respect to the curved main portion of the intermediate wall 13 into alignment with the leg 16. This is indicated in FIG. 2 by the fact that the entire intermediate wall 13 is spherically curved with a radius R, whereas the transition to the peripheral portion 18, which is in the vicinity of the apex of the angular ring 15, has a somewhat smaller radius r.

Figure 2:
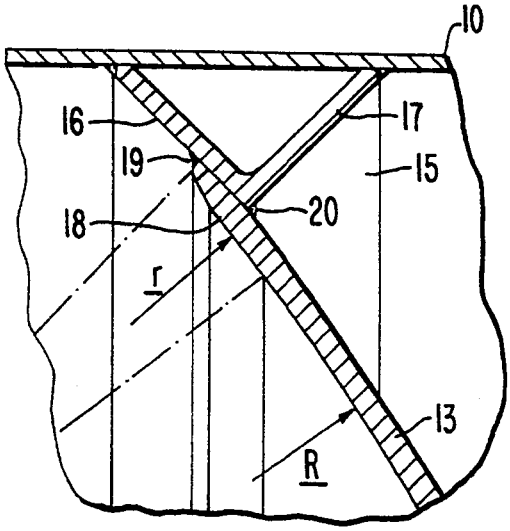
FIGS. 2 and 3 are representations of the areas II and III of FIG. 1 on an enlarged scale.
Figure 3:
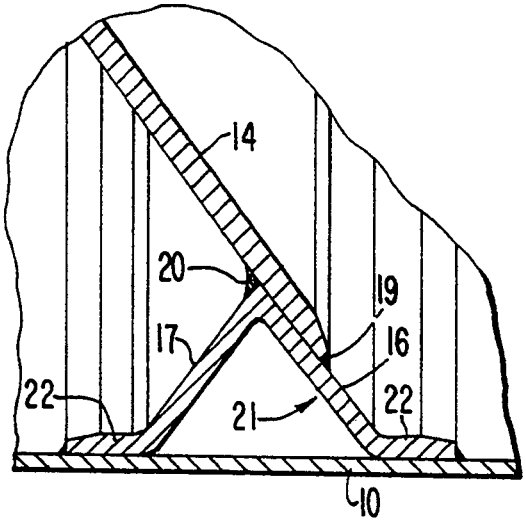

The embodiment of FIG. 3 differs from that of FIG. 2 in that it uses an angular ring 21 having a hat-shaped profile. According to FIG. 3, the ring 21 is welded to the tank jacket 10 along the peripheral edges of its cylindrical flanges 22.

Figure 4:
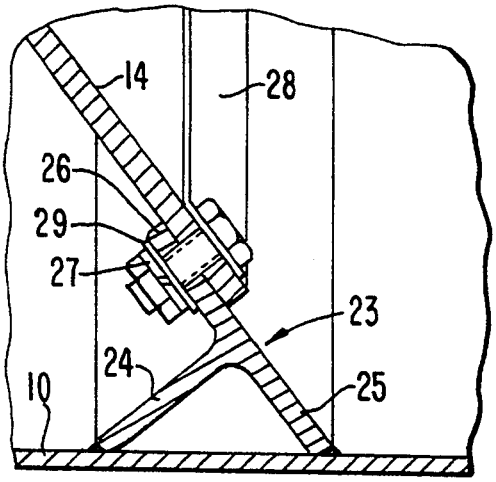
FIG. 4 is a modification in a view similar to FIG. 3.

In the embodiment of FIG. 4, the profile ring 23 has a T-profile and is welded to the tank jacket 10 by the outer edges of its center web 24 and of one leg 25 of its transverse web. The intermediate wall 14 is screwed to the other leg 26, with safety spring washers 27 being required particularly in case of an anti-surge intermediate wall, to take account of the varying loads which then act on the screw connections.

In addition, washers 28, 29 are provided to enlarge the supporting areas in order to distribute the substantial forces more uniformly to the peripheral portion of the intermediate wall 14 and the leg 26 of the profile ring 23. In FIG. 4, the washer 28 on the side of the intermediate wall 14 is shown as a continuous conical ring extending throughout the periphery.

In assembling the tank of FIG. 1, the two intermediate walls 13, 14 and the profile rings 15, 21 are inserted into the tank jacket 10 when the latter is still open at at least one end. In this condition, the rings 15, 21 are open at at least one location and may be cut the exact lengths at the assembly site within the tank and then welded to the inner wall of the jacket. Subsequently, the abutting ends of each ring 15, 21 are welded together. The intermediate walls 13, 14 are then welded to the rings 15, 21, respectively. Finally, the ends of the tank jacket 10 are closed with the two heads 11.

The overlap welds between the profile ring 15, 21 and the inner side of the tank jacket 10 may be inspected through simple control bores.

We claim:

1. A tank having a substantially cylindrical jacket, a profile ring having two legs, said two legs connected to each other to form an apex and said two legs being welded to the internal surface of said tank jacket so that said apex faces the interior of the tank, and a curved intermediate wall having a peripheral portion overlapping and welded to one of the legs of said profile ring.

2. The tank of claim 1, wherein the profile ring has a hat-shaped profile with cylindrical flanges, the ring being welded to the tank jacket at outer edges of said cylindrical flanges.

3. The tank of claim 1, wherein the profile ring has a T-profile including a center web and a transverse leg, a lower edge of said center web and an outer edge of said transverse leg being welded to the tank jacket.

4. The tank of claim 3, wherein the intermediate wall is screwed to said transverse leg of the profile ring.

5. The tank of claim 1, wherein the peripheral portion of the intermediate wall extends substantially parallel to a leg of the profile ring.

* * * * *